US006675703B2

(12) United States Patent
Bernabeu

(10) Patent No.: US 6,675,703 B2
(45) Date of Patent: Jan. 13, 2004

(54) MACHINE TO SIMULTANEOUSLY HOT-PRESS, PRINT, FLOCK IMPRINT AND BRUSH

(75) Inventor: Rafael Pascual Bernabeu, Avda. Benilloba, 3, 03820 Cocentaina Alicante (ES)

(73) Assignee: Rafael Pascual Bernabeu, Alicante (ES)

( * ) Notice: Subject to any disclaimer, the term of this patent is extended or adjusted under 35 U.S.C. 154(b) by 11 days.

(21) Appl. No.: 10/071,232

(22) Filed: Feb. 11, 2002

(65) Prior Publication Data

US 2003/0097943 A1 May 29, 2003

(30) Foreign Application Priority Data

Nov. 29, 2001 (ES) ..... 200102663

(51) Int. Cl.[7] ..... B05D 1/16; B41L 13/04

(52) U.S. Cl. ..... 101/116; 427/462; 427/465; 427/200

(58) Field of Search ..... 428/88, 90; 427/462, 427/463, 464, 465, 200, 206; 101/116, 117, 118, 119

(56) References Cited

U.S. PATENT DOCUMENTS

| | | | | | |
|---|---|---|---|---|---|
| 3,518,154 | A | * | 6/1970 | Broadhurst | 428/89 |
| 3,591,401 | A | * | 7/1971 | Snyder et al. | 428/88 |
| 3,616,135 | A | * | 10/1971 | Tesainer et al. | 428/88 |
| 4,111,733 | A | * | 9/1978 | Periers | 156/204 |
| 4,180,606 | A | * | 12/1979 | Hance et al. | 428/88 |
| 5,028,011 | A | * | 7/1991 | Schiffers | 242/527 |
| 6,257,135 | B1 | * | 7/2001 | Dorton, Jr. | 101/32 |

* cited by examiner

*Primary Examiner*—Daniel J. Colilla
(74) *Attorney, Agent, or Firm*—Staas & Halsey LLP

(57) ABSTRACT

Machine to simultaneously hot-press, print, flock imprint and brush, especially suitable for the production of printed and flocked fabrics, including a fabric reel, a fabric accumulator, a pre-treatment device, a first continuous oven drier, a hot-pressing device, a first cooling device, a printing device including rotary rollers for applying color printing paste and flock adhesive paste, a flock dispensing device, a flock embossing device, a second continuous oven drier for thermally fixing the flock adhesive and color printing pastes, a second cooling device, a brushing battery, a roller for winding, and a cutter.

24 Claims, 9 Drawing Sheets

MACHINE TO SIMULTANEOUSLY HOT-PRESS, PRINT, FLOCK IMPRINT AND BRUSH

BACKGROUND OF THE INVENTION

1. Field of the Invention

The present invention is directed to machines for decorating fabric and, more particularly, to a machine capable of simultaneously hot-pressing, printing, flock impregnating and brushing fabric.

2. Description of the Related Art

At present, there are several fabrics on the market having printed and flocked finishes. These fabrics are manufactured in separate printing and flocking stages, besides intermediate hot-pressing, brushing, drying, imprinting processes, etc.

The preparation of these fabrics involves numerous disadvantages and problems, due to their complicated logistics, potential lack of quality, and lack of matching between the printed and flocked designs. Further, the different processes involve transport and waiting between the steps, a fact that increases manufacturing costs and the plant area necessary.

SUMMARY OF THE INVENTION

Accordingly, it is a purpose of the present invention to provide a machine to simultaneously hot-press, print, flock imprint and brush to obtain a quality fabric with matched printed and flocked designs.

It is another purpose of the present invention to provide a continuous process for executing these operations in a single machine with a perfect match between them, without the production of defects or anomalies.

To achieve the foregoing and other purposes of the present invention there is provided a machine to simultaneously and continuously hot-press, print, flock, imprint and brush fabric, including the following structures and steps:

Subjecting the fabric to pre-treatments, like coloring, sizing, closure of pores, fireproofing and/or anti-stain treatments.

Drying of the pre-treatments prior to the fabric commencing the printing process.

Hot-pressing of the fabric before the printing process. The fabric is smoothed and wrinkles are eliminated so as not to produce defects and folds prior to the printing process.

Consecutive printing of colors with a rotary cylinder system and color paste to obtain clear definition, and to avoid saturation of colors between areas of different hues.

Applying adhesive paste via perforations around a cylinder to correspond to a flock design for the fabric.

Flocking is carried out by an electrostatic flocking mechanism with a fabric sieve which controls flock distribution, across the entire fabric width, and an electrostatic grid which charges the flock material positively, so that it is orientated vertically relative to a negatively charged adhesive. This way of distributing the flock eliminates free fall of the flock material and produces a better finish.

Suctioning of surplus flock—any surplus flock is suctioned and re-used.

Drying and heat setting of the printing and adhesive pastes in an oven, during which a pin stenter system keeps the fabric taught and prevents the formation of wrinkles.

Passing the fabric through cylinders cooled by water, thereby increasing the rigidity of the flock.

Continuous smooth brushing. A final brushing of the totally finished surface to eliminate possible remains and to check quality.

Rolling of the fabric and preparation for its dispatch. Since the fabric is cold and clean, there is no problem of introducing defects, such that rolling may be performed directly.

Other features and advantages of the present invention will be apparent from the following description taken in conjunction with the accompanying drawings, in which like reference characters designate the same or similar parts throughout the figures thereof.

DETAILED DESCRIPTION OF THE PREFERRED EMBODIMENTS

The embodiments of the present invention will now be described in greater detail with reference to FIGS. 1–9.

Figure 1:
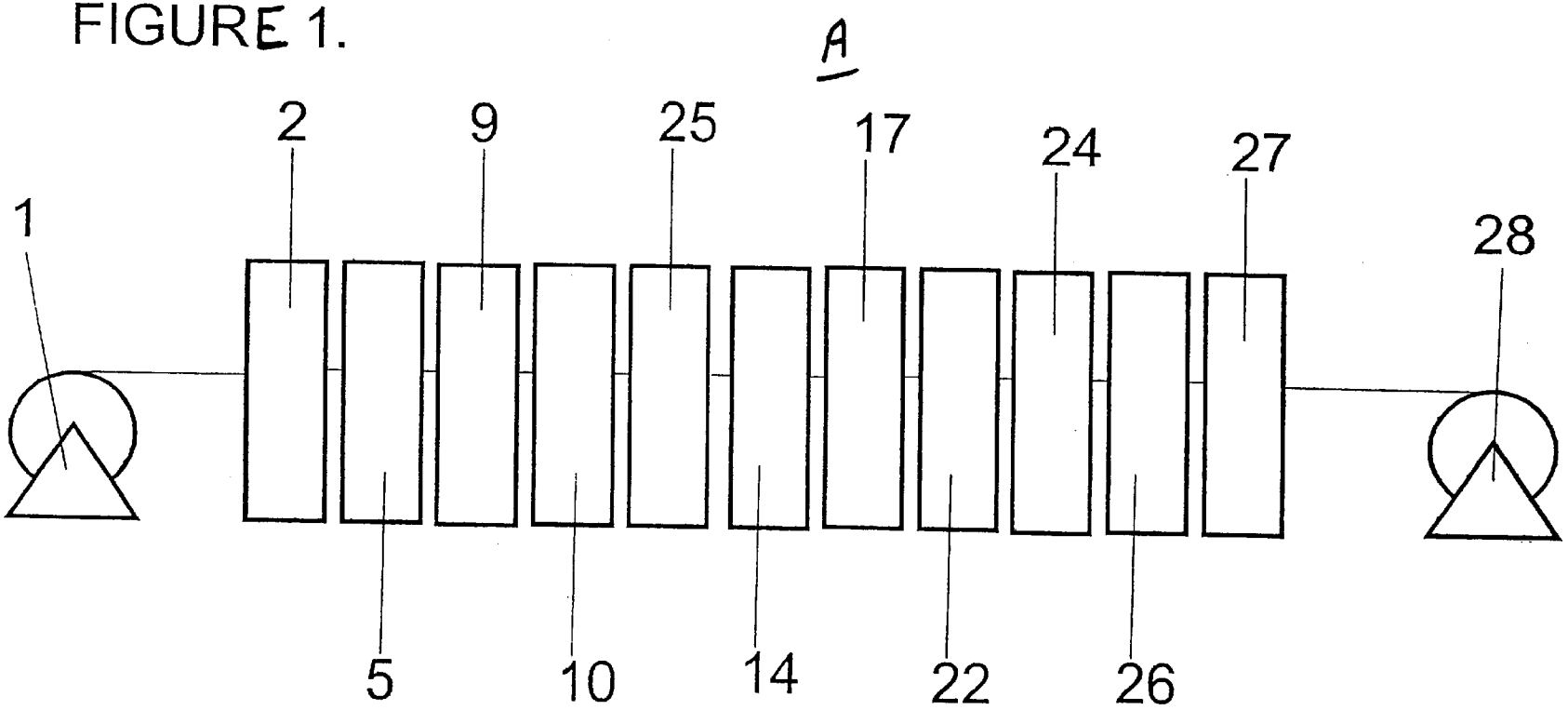
FIG. 1 is a schematic diagram of the machine.
Figure 2:
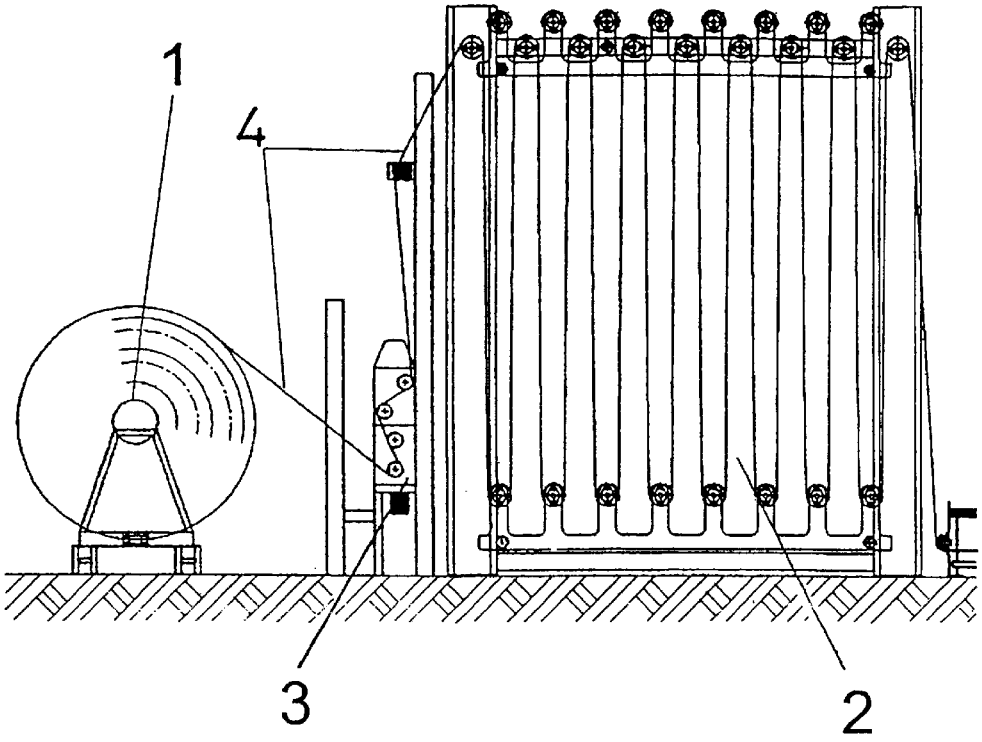
FIG. 2 is a schematic elevational view of a fabric accumulator.

As shown particularly in FIGS. 1–2, a first, beginning end (left side of FIG. 1) of the continuous machine (A) of the present invention includes a reel (1) that feeds a fabric (4) to an accumulator (2), across pressure cylinders (3).

As best shown in FIG. 2, the accumulator (2) keeps a certain amount of fabric (4) ready to be processed. The accumulator (2) is continuously fed by the reel (1) and permits the machine (A) to continue operating, even when the reel (1) is changed. The accumulator (2) includes the pressure cylinders (3) at an entrance thereof and cylinder frames between which the fabric (4) is arranged in an accordion manner. The pressure cylinders (3) may, at a given moment, stop the feed of the fabric (4) to the machine (A) and facilitate the union of the next reel (1), the machine (A) consuming the accumulated fabric.

Figure 3:
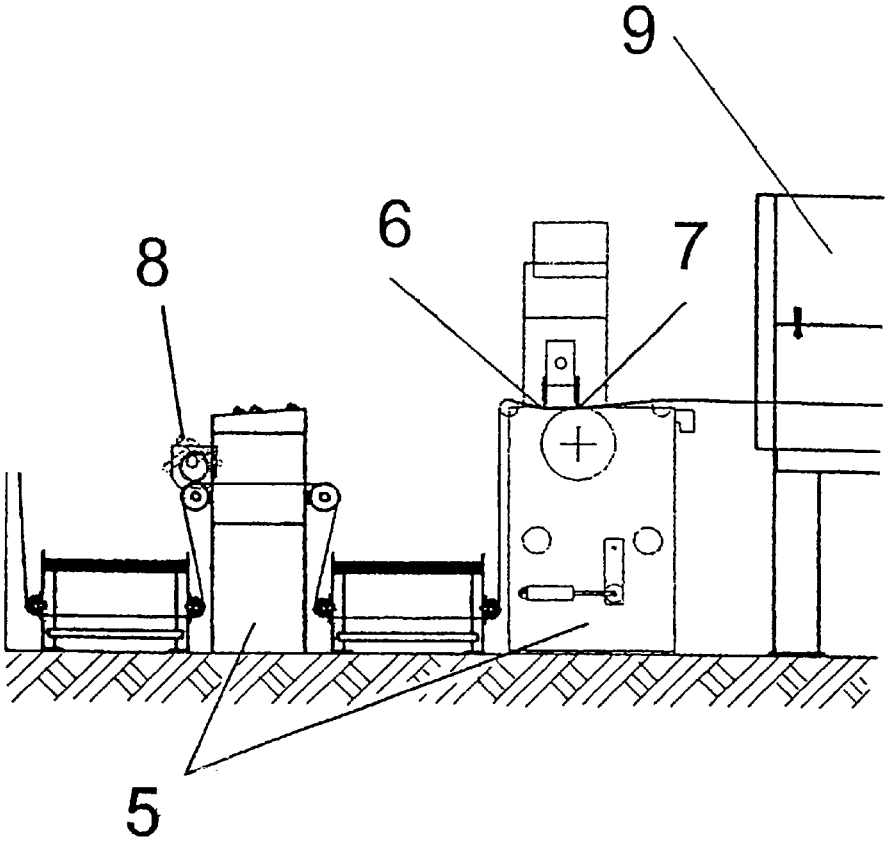
FIG. 3 is a schematic elevational view of a pre-treatment device.

As best shown in FIGS. 2 and 3, at the exit of the fabric accumulator (2), there is a pre-treatment device (5). As known in the art, such a device usually coats the fabric (4) with a background color, but can also include other treatments, like sizing, closure of pores with paste, which improves print application, fireproofing and/or anti-stain treatments.

The device (5) can apply paste using at least one of three main types of applicators depending on the finish desired. One applicator includes a first pitched knife (6), over the fabric 4, such that the paste is applied over the entire fabric surface. A second pitched knife (7) can be used, again touching the fabric surface and being used when a thinner treatment is desired. Finally a rotary cylinder (8) can be used around which is a perforated contour having a design engraved thereon. This cylinder includes paste in its interior, and an interior knife (not shown) pushes the paste through the perforated contour of the cylinder (8) against the fabric.

Figure 4:
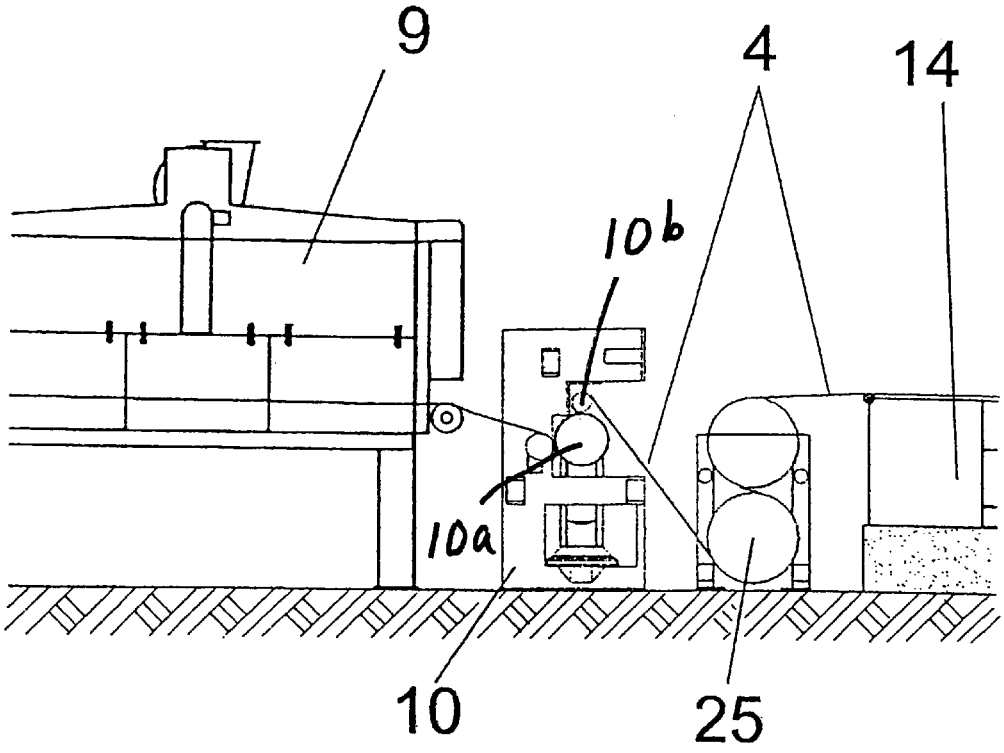
FIG. 4 is a schematic elevational view of a first drier, a hot-pressing device and a first cooling device.

As best shown in FIGS. 1, 3 and 4, after the pre-treatment the device (5), there is a first continuous oven drier (9) to dry the fabric (4) prior to being printed. This drier (9) fixes the bottom-coat, background color, pore closing treatment, etc. applied by the pre-treatment device (5). The drier (9) also eliminates any humidity and cures any additives to prevent the flock applied later from adhering in an undesired manner.

The first drier (9) is followed by a hot-pressing device (10) including two cylinders **(10*a*, 10*b*) opposite each other, through which the still hot fabric (4) moves under pressure. In this process, the fabric (4)** is smoothed and wrinkles are eliminated so as not to produce defects and folds for the printing step.

Then, the fabric (4) moves to a first cooling device (25) including two cylinders opposite each other, through which water cooled between approximately 5° C. and 10° C. circulates.

Figure 5:
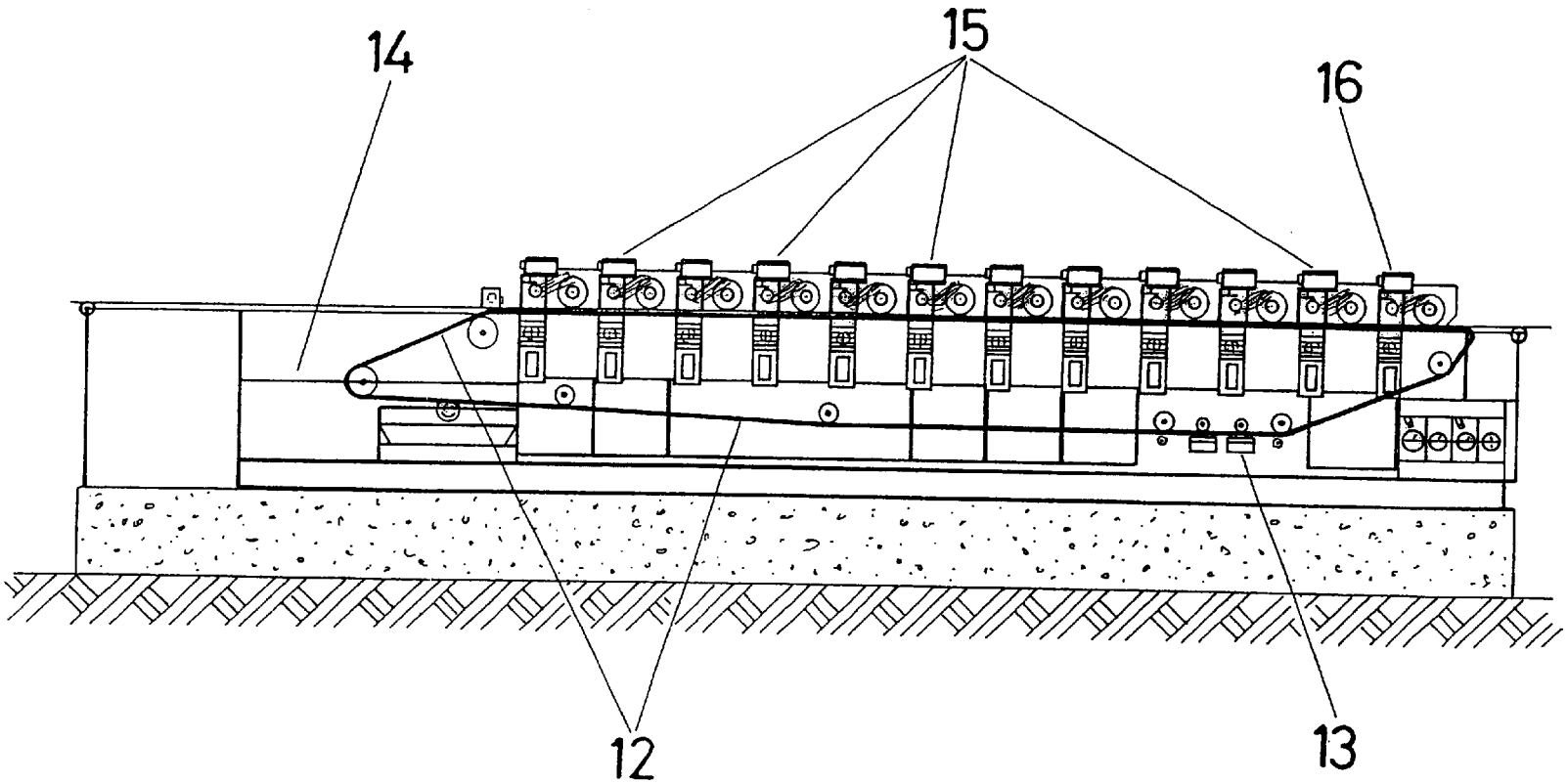
FIG. 5 is a schematic elevational view of a printing device.

As best shown in FIGS. 1, 4 and 5, the fabric (4) then moves to a printing device (14), which has a lattice apron (12) covered with adhesive and positioned on a bedplate. This adhesive fixes the fabric over the apron to prevent movements during print application. The adhesive is applied when the lattice apron circulates through the lower part of the bedplate, at the return of the fabric (4). The latter is stuck by contact remaining fixed during all its run until removed at the end of the bedplate. The apron is cleaned at device (13) with brushes and water in an operation prior to the application of a new layer of adhesive.

On an upper surface of the lattice apron (12), there is located a plurality of rotary cylinders (15) for color application, in sufficient number for the colors to be applied, arranged tangentially to the lattice apron (12). A last rotary cylinder (16) is a flock adhesive applier. This cylinder (16) includes engraving corresponding to the design desired for the flocking.

The rotary cylinders (8, 15 and 16) are paste dispensers, each including a cylinder engraved on a contour, to include several minute holes defining a design to be applied to the fabric via flocking. Each cylinder has in its interior a longitudinal pressure pitched knife (not shown) forcing the paste outwardly against the cylinder holes next to an area tangential to the fabric (4). Moreover, each cylinder interior includes an electronic pressure probe connected to an external paste feed pump (not shown). Each cylinder also has on a shaft thereof, an independent motor (not shown) with variable speed and programmable with an angular setting memory synchronized with the other mechanical components of the machine (A). All the cylinders (15) are operated to achieve matching of colors.

Thus, the conventional colorants and liquid adhesives have been replaced in the present invention by color and adhesive pastes, resulting in less diffusion during application over the fabric. This technical solution is an advantage, because the limits between color and adhesive areas are more defined, preventing the saturation effect which accompanies liquid products. Moreover, the circulation of wet fabric through the machine is prevented, requiring shorter drying times.

In light of the above, in the cylinders (8, 15) of the pre-treatment device and the printing device, and the flock adhesive application cylinder (16), a paste is used. These cylinders have respectively, on their contour the corresponding design to be applied engraved thereon, including the plurality of small perforations through which the paste is expelled via the internal longitudinal knife. The knife is arranged next to the contact zone with the fabric, so that the paste is applied at the point of closest contact. All these cylinders have their own motoring with speed adjuster and position memory. The speed adjuster allows the cylinder rotation to be adjusted according to the circumference of the contour and hence, prevents non-matching of the applications as the fabric (4) circulates through the machine. The position memory permits each cylinder to be placed in the correct angular position, when first starting the machine or after stopping. Hence, fabric consumption is prevented in test operations, when adjusting the printing and flocking parameters. The paste is fed from inside the cylinder by the external pump. The internal electronic probe measures the amount of paste inside the cylinder. As the paste is consumed, the probe detects same, and activates the feed pump until the paste is refilled. This system assures that paste application is uniform at a specific pressure, obtaining correct dispensing of the paste over the fabric.

As the fabric leaves the printing device (14), it detaches from the lattice apron (12) which transported it in the printing bedplate, and is collected by a pin stenter fastening system, which optionally may be a clip system. Pin stenters are known in the art, wherein they are also referred to as pin tenters, or needle stentors or tentors. Such devices include a row of pins or needles on both sides of the fabric to keep the fabric taught and to continuously feed same through a machine for processing.

Figure 6:
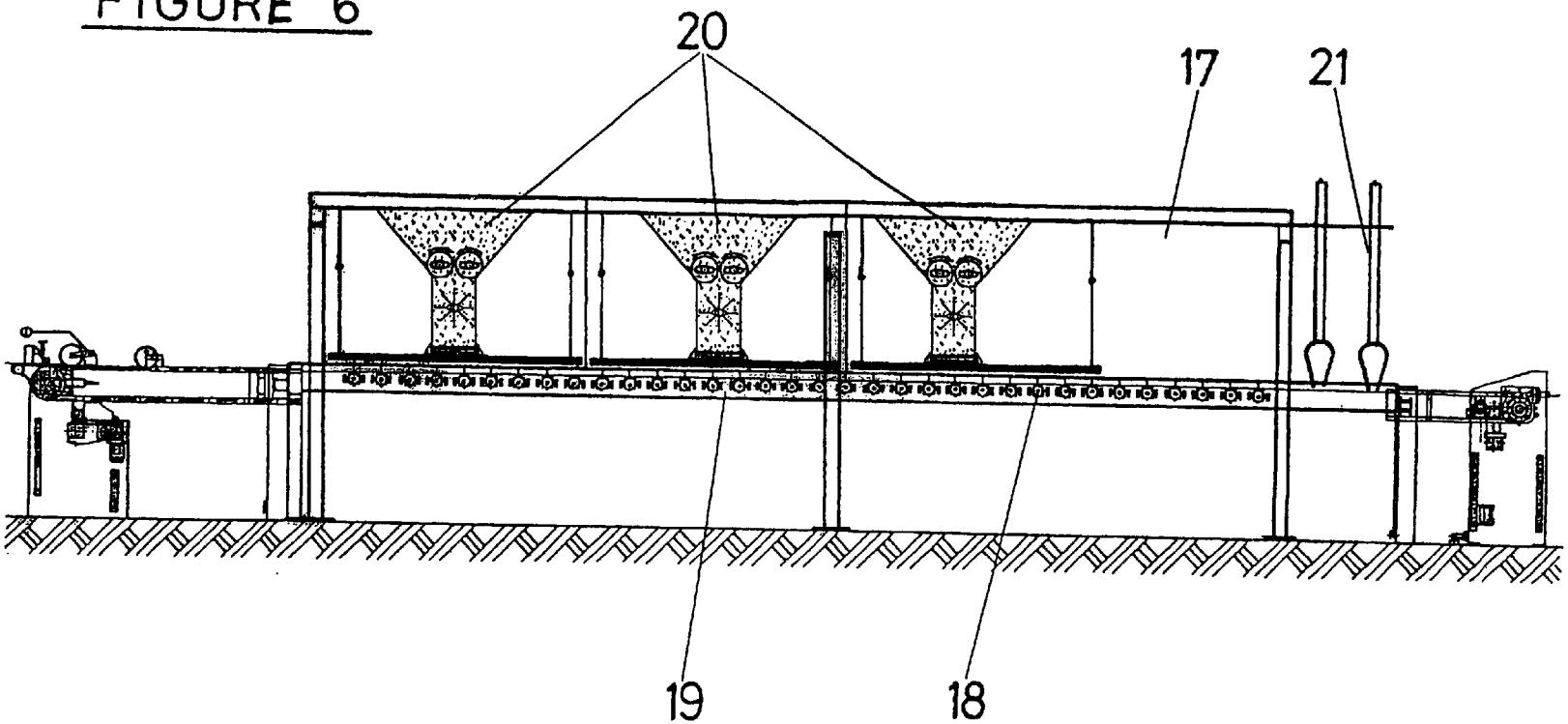
FIG. 6 is a schematic elevational view of a flock dispensing device.
Figure 7:
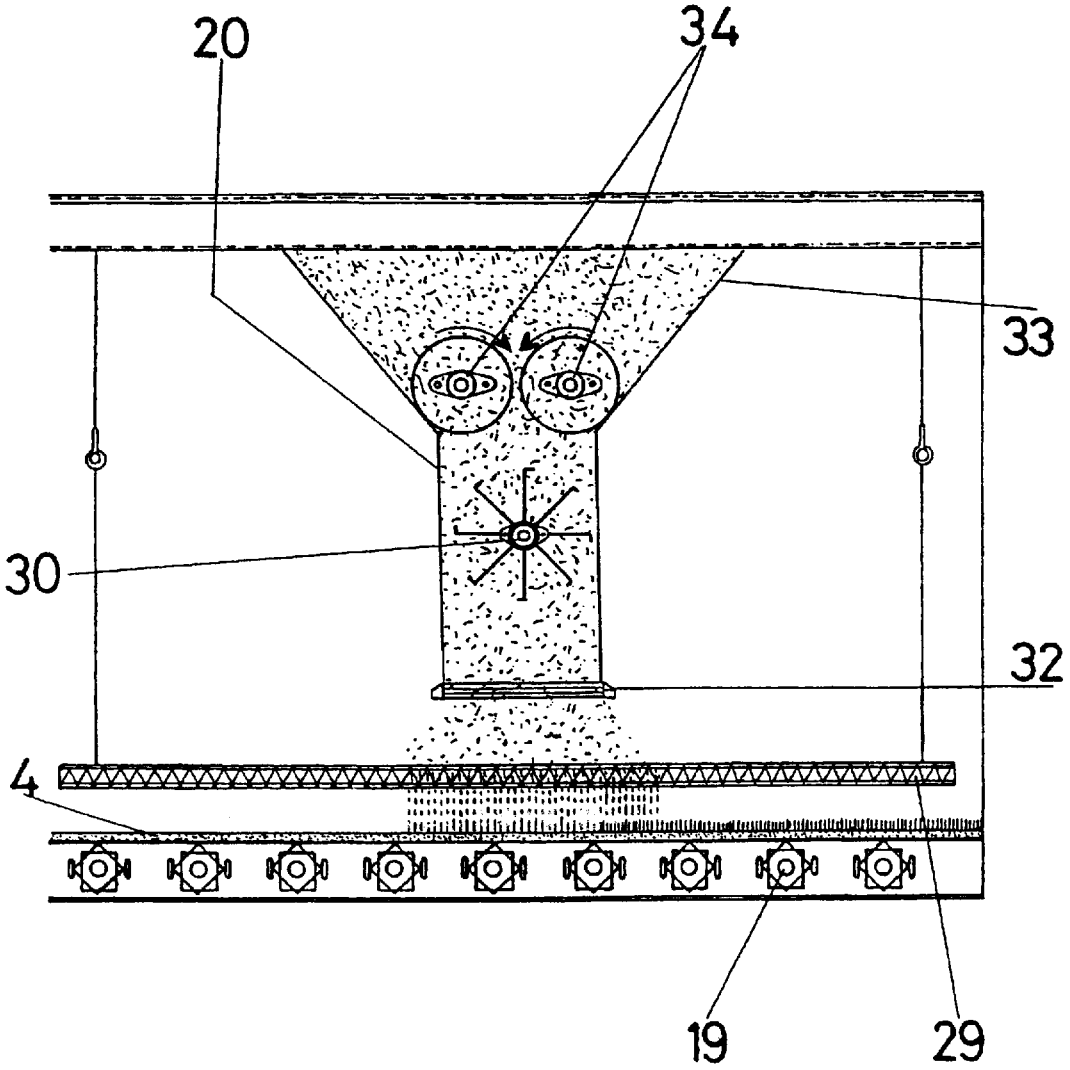
FIG. 7 is a schematic elevational view of one of the flock dispensers.

As best shown in FIGS. 6, and 7, after the printing device (14), there is a device (17) for dispensing flock over the fabric (4). The device (17) includes a closed bedplate with an air conditioning system, a fabric transporter (18), using a pin stenter or similar, and a series of non-cylindrical rotating bars (19) along the transporter (18) for shaking the fabric (4).

The air conditioning system maintains the interior flock dispenser device (17) of the interior at a constant temperature and controls humidity for the correct diffusion of flock.

Over the transporter (18), there are preferably three electrostatic flock dispensers (20), which ensure that the flock is adhered vertically over the adhesive on the fabric applied by the cylinder (16), improving the presentation of the fabric, and increasing wear resistance. As best shown in FIG. 7, each flock dispenser (20) includes an upper hopper (33) containing flock, and a pair of rotary dispensing cylinders (34) feeding flock to a flock distribution blade (30) and to a fabric sieve (32). The flock falls on the fabric sieve (32) and is uniformly dispersed on the fabric thereby. Beneath the fabric sieve (32), there is an electrostatic grid (29), spaced relative to the circulating fabric (4).

The electrostatic grid (29) charges the flock filaments with a positive electric charge, making them orientate vertically with respect to the negative charge communicated to the adhesive/fabric passing below. The positively charged flock which falls under gravity is stuck to the negatively charged adhesive in a vertical position, in search of the discharge.

At an exit end of the flock dispensing device (17) there are two aspirators (21) that suction any non-adhered flock and resend it to the dispensing hoppers (33) for recycling. That is, given that the amount of flock supplied is in excess, any surplus may be eliminated by suctioning and returning same to the flock dispensing device (17). Moreover, since the adhered flock is arranged vertically, it is more resistant than the fiber deposited in the areas without adhesive, so that cleanliness is greater.

Figure 8:
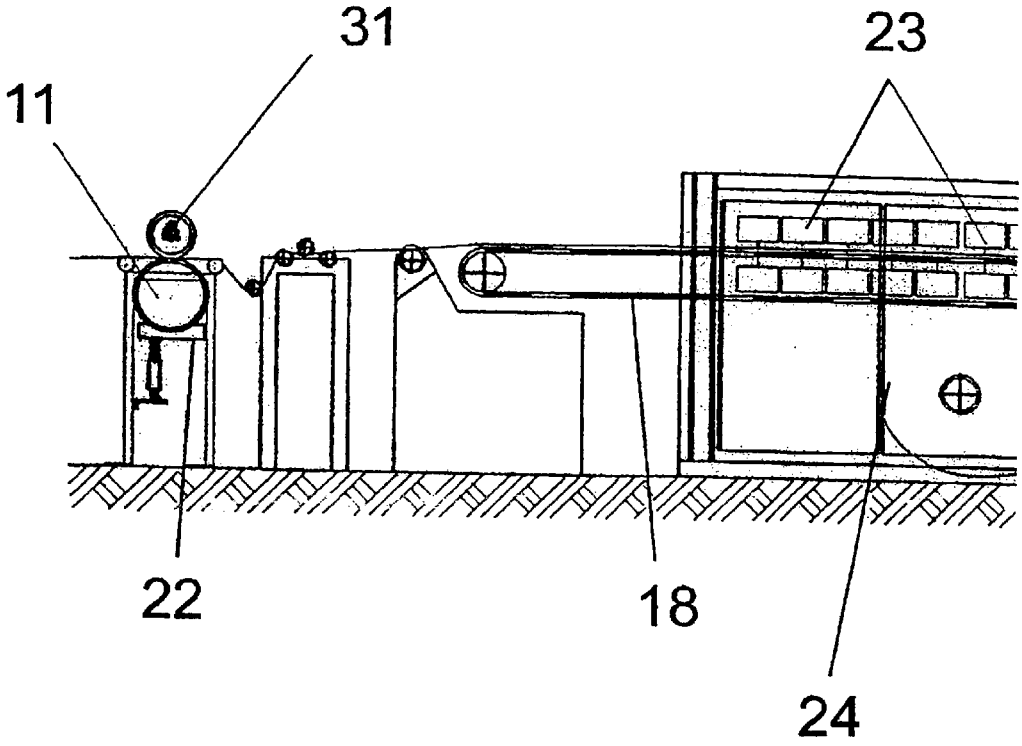
FIG. 8 is a schematic elevational view of an embossing device and an entrance to a second drier.

As best shown in FIG. 8, after the flock dispensing device (17), there is an embossing or wofering device (22) including a rotating engraved cylinder (31), opposite a counter cylinder (11), with a pitched separation. Between both cylinders (31 and 11) the fabric (4) circulates under pressure.

Thus, after application of the flock, if desired, the flocked fabric is submitted to embossing. On the surface of the counter cylinder (11) there is a design in relief corresponding to the design given to the flock, the adhesive still being soft to provide determined shapes and orientations of the flock.

Afterwards, there is a second oven drier (24) for thermofixing the flock adhesive and printing color pastes, again relying upon a fabric transporter (18) with a pin stenter or clips to move the fabric and prevent the formation of wrinkles in the flocking. The second oven drier (24), has its length divided in different zones with temperature adjustable heaters (23).

Once the fabric (4) has left the second oven (24), the flocking is still weak due to the temperature and may suffer deformations due to treading or contact. For this purpose, the fabric is again passed through a second cooling device (26), including two opposite cylinders, through which water cooled between approximately 5° C. and 10° C. circulates. The contact of the continuous fabric with the cooled cylinders sets the adhesive and fixes the flock rigidly to the fabric.

Figure 9:
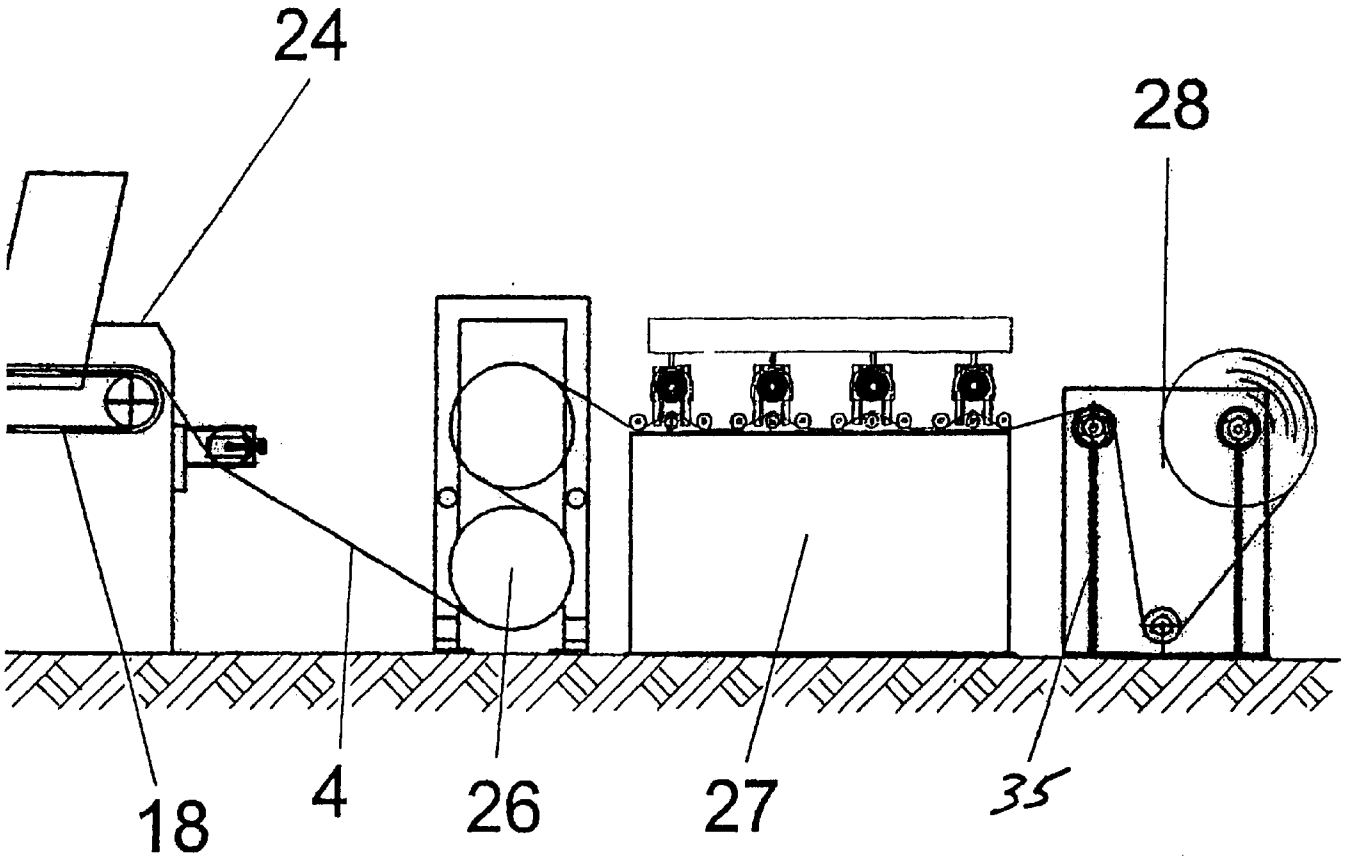
FIG. 9 is a schematic elevational view of an exit from the second drier, a second cooling device, a brush battery and a roller.

The fabric (4) then moves towards a brushing battery (27), as shown best in FIG. 9. The brushing battery (27) includes a series of brushes applied over the flocked fabric surface, there being shaking bars arranged on a back thereof. At this stage there is a final brushing of the totally finished surface to eliminate possible remains and to check quality. Next to each one of said brushes, there is an air expansion cyclone aspirator (not shown), opposite the flocked surface for suctioning loose flock, and directing same to collection bags.

As a last stage of the machine (A) production line, there is a roller (28) and a cutter (35). Since the fabric is cold and clean, there is no problem of introducing defects by contact or similar, such that rolling may be performed directly.

This cutter (35) is used when the roller (28) reaches the desired amount of wound fabric, and a new roller (28) is necessary.

The mentioned machine stages are synchronized by electronic, mechanical and electric synchronisms, permitting the start and simultaneous operation of the necessary stages, with the due corrections for a continuous quality production.

Based on this invention, it is possible to obtain quality fabrics comparable to those made by conventional systems like weft insertion weaving with pile (e.g., Chenilla) threads, made with a Jaquard system, or velvety fabrics, with significant advantages including a lower final fabric weight due to applying flock including just to the parts of fabric which will be visible, which is not possible with such conventional fabrics/processes.

The lower fabric weight obtained with the process and machine of this invention permits products to be made that may be used in, among other things, the decoration of bed covers, etc., where the weight is important.

The invention provides the following additional significant benefits:

Product quality is consistent.

Possibility of using a large variety of base fabrics and hence, production of a greater diversity of products, as well as price variation.

Possibility of using finer fibers (microfibers), demanded by the market.

High processing speed, compared to weaving

Competitive final product due to lower of production costs.

The foregoing is considered illustrative only of the principles of the invention. Further, since numerous modifications and changes will readily occur to those skilled in the art, it is not desired to limit the invention to the exact construction and operation shown and described. Accordingly, all suitable modifications and equivalents may be resorted to that fall within the scope of the invention and the appended claims.

What is claimed is:

1. A machine for the production of fabrics with printing and flocking, comprising:

in a single continuous production line, a pre-treatment device, a first drier, a hot-pressing device, a first cooling device, a printing device for applying flock adhesive and color printing pastes to the fabric, a flock dispensing device, a flock embossing device, a second drier for thermally fixing the flock adhesive and the color printing pastes, a second cooling device and a brushing battery, wherein the printing device includes:

a lattice apron arranged longitudinally over a bedplate, a surface of the lattice apron being covered by an adhesive for temporarily fastening the fabric to the lattice apron, and a plurality of rotary cylinders for applying the color printing paste, said plurality of rotary cylinders being arranged over the lattice apron and tangential to the fabric, and wherein one of the plurality of rotary cylinders applies the flock adhesive paste.

2. The machine according to claim 1, wherein, at a first end of the machine, there is a fabric reel linked to a fabric accumulator through pressure cylinders to provide a continuous feed of fabric to the pre-treatment device.

3. The machine according to claim 2, wherein at a second opposite end of the machine, there is provided a roller suitable for the continuous winding of the flocked fabric delivered by the brush battery.

4. The machine according to claim 1, wherein the pre-treatment device includes at least one of a first pitched knife touching a surface of the fabric, a second pitched knife touching the surface of the fabric and a rotary cylinder.

5. The machine according to claim 1, wherein each of the plurality of rotary cylinders is a hollow cylinder with a contour engraved with holes for dispensing the paste, has an interior knife pushing the paste through said holes, has an electronic probe linked to a feed pump to control an amount of paste in the cylinder, and is linked to a variable speed motor.

6. The machine according to claim 1, wherein at a first end of the flock dispensing device, there is at least one suction aspirator to collect non-adhered flock, and recycle the non-adhered flock back through the machine.

7. The machine according to claim 1, wherein the flock embossing device includes a cylinder engraved opposite a counter cylinder, with the fabric circulating between both under pressure.

8. The machine according to claim 1, wherein, between the brushing battery and the roller, there is located a cutter to separate the fabric being wound on the roller from the fabric at the brushing battery.

9. The machine according to claim 1, wherein a secondary process machine is inserted along the machine.

10. A machine for the production of fabrics with printing and flocking, comprising:

in a single continuous production line, a pre-treatment device, a first drier, a hot-pressing device, a first cooling device, a printing device for applying flock adhesive and color printing pastes to the fabric, a flock dispensing device, a flock embossing device, a second drier for thermally fixing the flock adhesive and the color printing pastes, a second cooling device and a brushing battery, wherein the flock dispensing device includes a first longitudinal transporter for the fabric, the first transporter including a series of shakers beneath the fabric, and at least one electrostatic flock dispenser arranged over the fabric.

11. The machine according to claim 10, wherein the first longitudinal transporter includes a pin stenter system for engaging and moving the fabric along the first transporter.

12. The machine according to claim 10, wherein the flock dispensing device includes an upper hopper with a plurality of rotary flock dispensing cylinders, a distribution blade, a fabric sieve, and beneath the fabric sieve, an electrostatic flock polarization grid spaced with respect to the fabric.

13. The machine according to claim 10, wherein the second drier includes a second fabric transporter including a series of adjustable temperature independent heaters distributed along its length.

14. The machine according to claim 13, wherein the second transporter includes a pin stenter system for engaging and moving the fabric along the second transporter.

15. A machine for the production of fabrics with printing and flocking, comprising:

in a single continuous production line, a pre-treatment device, a first drier, a hot-pressing device, a first cooling device, a printing device for applying flock adhesive and color printing pastes to the fabric, a flock dispensing device, a flock embossing device, a second drier for thermally fixing the flock adhesive and the color printing pastes, a second cooling device and a brushing battery, wherein the brushing battery includes:

a plurality of brushes applied over the flocked fabric surface, a plurality of shakers beneath the fabric, and a flock aspirator adjacent the brushes.

16. A method for producing fabrics with printing and flocking, comprising the steps of:

in a single continuous production line, pre-treating the fabric, drying the pre-treated fabric, hot-pressing the fabric, cooling the fabric, printing on the fabric by applying flock adhesive and color printing pastes to the fabric, dispensing flock on the fabric, embossing the flock on the fabric, drying the fabric again to thermally fix the flock adhesive and the color printing pastes, cooling the fabric again, and brushing the fabric, wherein the printing step includes:

providing a surface of a lattice apron with a fabric adhesive for temporarily fastening the fabric to the lattice apron, and providing a plurality of rotary cylinders over the lattice apron, at least one of which applies the color printing paste, and at least another of which applies the flock adhesive paste.

17. The method according to claim 16, wherein the flock dispensing step includes the step of transporting the fabric, while the fabric is shaken from beneath.

18. The method according to claim 17, wherein the step of transporting the fabric includes the use of a pin stenter system for engaging and moving the fabric.

19. The method according to claim 16, wherein the flock dispensing step includes the steps of positively charging the flock, and negatively charging the flock adhesive.

20. The method according to claim 16, wherein, at an end of the flock dispensing step, non-adhered flock is collected and returned to a beginning of the flock dispensing step.

21. The method according to claim 16, further comprising the step of, at a first end of the line, accumulating and feeding the fabric to the pre-treating device.

22. The method according to claim 16, wherein, after the brushing step, the fabric is wound.

23. The machine according to claim 16, wherein, between the brushing step and the winding step, the fabric is cut.

24. A method for producing fabrics with printing and flocking, comprising the steps of:

in a single continuous production line, pre-treating the fabric, drying the pre-treated fabric, hot-pressing the fabric, cooling the fabric, printing on the fabric by applying flock adhesive and color printing pastes to the fabric, dispensing flock on the fabric, embossing the flock on the fabric, drying the fabric again to thermally fix the flock adhesive and the color printing pastes, cooling the fabric again, and brushing the fabric, wherein, during the brushing step, the fabric is shaken.

* * * * *

UNITED STATES PATENT AND TRADEMARK OFFICE

CERTIFICATE OF CORRECTION

PATENT NO. : 6,675,703 B2
DATED : January 13, 2004
INVENTOR(S) : Rafael Pascual Bernabeu It is certified that error appears in the above-identified patent and that said Letters Patent is hereby corrected as shown below:

Title page,
Item [75], Inventor, change "3,03820" to -- 3 03820 --.

Signed and Sealed this

Sixth Day of July, 2004

JON W. DUDAS
*Acting Director of the United States Patent and Trademark Office*